US010265634B2

(12) United States Patent
Daly et al.

(10) Patent No.: US 10,265,634 B2
(45) Date of Patent: Apr. 23, 2019

(54) TOY VEHICLE TRACK SET

(71) Applicant: Mattel, Inc., El Segundo, CA (US)

(72) Inventors: Scott Daly, Los Angeles, CA (US); Paul Schmid, Ojai, CA (US)

(73) Assignee: Mattel, Inc., El Segundo, CA (US)

( * ) Notice: Subject to any disclaimer, the term of this patent is extended or adjusted under 35 U.S.C. 154(b) by 171 days.

(21) Appl. No.: 15/277,012

(22) Filed: Sep. 27, 2016

(65) Prior Publication Data

US 2017/0087478 A1 Mar. 30, 2017

Related U.S. Application Data

(60) Provisional application No. 62/233,818, filed on Sep. 28, 2015.

(51) Int. Cl.
*A63H 18/02* (2006.01)
*A63H 33/08* (2006.01)

(52) U.S. Cl.
CPC ..... *A63H 18/021* (2013.01); *A63H 18/028* (2013.01); *A63H 33/086* (2013.01)

(58) Field of Classification Search
CPC ..... A63H 18/00; A63H 18/02; A63H 18/021; A63H 18/04
See application file for complete search history.

(56) References Cited

U.S. PATENT DOCUMENTS

| | | | | |
|---|---|---|---|---|
| 1,252,616 | A | 1/1918 | Reif | |
| 1,599,699 | A | 9/1926 | Zabel | |
| 1,828,536 | A | 10/1931 | Koerber | |
| 2,999,689 | A | 9/1961 | Litwinczuk | |
| 3,581,987 | A | 6/1971 | Tomaro | |
| 3,712,538 | A | 1/1973 | Starr et al. | |
| 4,516,953 | A | 5/1985 | Hippely et al. | |
| 4,519,789 | A | 5/1985 | Halford et al. | |
| 6,170,754 | B1 * | 1/2001 | Halford | A63H 18/04 104/56 |
| 8,608,527 | B2 | 12/2013 | O'Connor et al. | |
| 8,944,882 | B2 | 2/2015 | O'Connor et al. | |
| 9,345,979 | B2 | 5/2016 | Matthes et al. | |
| 9,421,473 | B2 | 8/2016 | Ostendorff et al. | |
| 9,452,366 | B2 | 9/2016 | Schmid et al. | |
| 9,457,284 | B2 | 10/2016 | Ostendorff | |

* cited by examiner

*Primary Examiner* — Robert J McCarry, Jr.
(74) *Attorney, Agent, or Firm* — Edell, Shapiro & Finnan, LLC

(57) ABSTRACT

A toy vehicle track set is disclosed herein. The track set includes at least one track section and a support that can hold the track section in a particular orientation or position relative to a support surface. In one embodiment, the support includes a base, a support member that is coupleable to the base, and a coupler that is connected to the support member. The track section can be engaged with the coupler which is movably mounted to the support member.

20 Claims, 11 Drawing Sheets

TOY VEHICLE TRACK SET

CROSS-REFERENCE TO RELATED APPLICATION

This application claims priority to and is based on U.S. Patent Application No. 62/233,818, filed Sep. 28, 2015, entitled "TOY VEHICLE TRACK SET," the entire disclosure of which is incorporated herein by reference in its entirety.

FIELD OF THE INVENTION

The present invention relates to a toy vehicle track set. More specifically, the invention relates to a toy vehicle track set that includes mounting components or couplers that allow for creative play with the set.

BACKGROUND OF THE INVENTION

Current toy vehicle track sets often include one or more track sections and sometimes a booster that propels a toy vehicle along the track sections. Often, play with the track sections is limited to toy vehicles traveling in a generally horizontal manner or in a pre-defined loop. In such current track sets, a user can connect track sections together, but the arrangement and orientation of the track sections are limited to positions in substantially horizontal and vertical planes. This limitation reduces the quantity of potential configurations of the track set.

It would be desirable to provide a toy vehicle track set that enables a user to position track sections in a variety of orientations, thereby creating a variety of pathways for a toy vehicle. Moreover, it would be desirable to provide a toy vehicle track set that allows track sections to be positioned in a variety of curved configurations which would increase the creativity of the track set and enable users to experiment more.

SUMMARY OF THE INVENTION

A toy vehicle track set according to the present invention includes one or more track sections, and a support to which at least one the track sections is coupled. The support includes an elongate member and a base. The elongate member is mounted on the base and includes at least one coupler movably coupled thereto. The coupler is sized so that a track section can slide onto the coupler.

In one embodiment of the present invention, a toy vehicle track set comprises a track section having a mounting portion; and a support configured to be placed on a support surface, the support including a base defining a receptacle; and a support member removably coupleable to the base, the support member having a first end and a second end opposite the first end, at least one of the first end and the second end being insertable into the receptacle of the base, the support member having a coupler movably connected thereto, the mounting portion of the track section being slidable onto the coupler so that the track section is connected to the support and can be moved relative to the support.

In one alternative embodiment, the coupler is removably coupled to the support member. In another embodiment, the mounting portion of the track section includes a pair of rails, and the coupler engages the rails. In another embodiment, the coupler includes a flange portion and the flange portion engages each of the rails. In another embodiment, the flange portion has a ring shape.

In one alternative embodiment, the track section has a lower surface, the flange portion of the coupler includes ridges formed thereon, and the ridges on the flange portion engage the lower surface of the track section.

In one alternative embodiment, the coupler has a flange portion and a body portion, and an outer diameter of the flange portion is larger than an outer diameter of the body portion.

In one alternative embodiment, the support member includes a mounting component with a ball-shaped connection, and the coupler can snap onto and pivot about the ball-shaped connection. In another embodiment, the coupler includes a pair of arms defining a central region, and the ball-shaped connection is insertable into the central region. In yet another embodiment, the support member is elongate.

In another embodiment, the receptacle of the base is a first receptacle and the base includes a second receptacle, the second receptacle of the base being sized to retain a toy building block therein. In another embodiment, the track set includes a toy building block insertable into the second receptacle.

In another embodiment of the present invention, a toy vehicle track set comprises a track section having a lower surface and a mounting portion proximate to the lower surface; and a support that supports the track section, the support including a base defining a receptacle; and an elongate member removably coupleable to the base, the elongate member being insertable into the receptacle of the base so that the elongate member is supported above a support surface, the elongate member having a coupler rotatably and removably connected thereto, the mounting portion of the track section being slidable onto the coupler so that the track section is connected to the support and can be moved relative to the support.

In another embodiment, the mounting portion of the track section includes a pair of rails that extend from the lower surface of the track section, and the coupler engages the rails. In another embodiment, the coupler includes a ring-shaped flange portion and the flange portion engages each of the rails when the track section is slid onto the coupler.

In another embodiment, the flange portion of the coupler includes ridges formed thereon, and the ridges engage the lower surface of the track section. In another embodiment, the elongate member includes a mounting component with a ball portion, and the coupler snaps onto and pivots about the ball portion. In another embodiment, the coupler includes a pair of arms defining a central region, and the ball portion is insertable into the central region.

In another embodiment of the present invention, a toy vehicle track set comprises a track section having a lower surface and a mounting portion proximate to the lower surface; and a support including a base defining a receptacle; and an elongate member removably coupleable to the base, the elongate member being insertable into the receptacle of the base so that the elongate member is supported above a support surface, the support member having first and second mounting portions and first and second couplers rotatably and removably connected to a respective one of the mounting portions, the mounting portion of the track section being slidable onto one of the first and second couplers so that the track section is connected to the support and can be moved relative to the support.

In another embodiment, the first coupler and the second coupler are movable independent of each other.

BRIEF DESCRIPTION OF THE DRAWINGS

Like reference numerals have been used to identify like elements throughout this disclosure.

DETAILED DESCRIPTION OF THE INVENTION

The present invention disclosed herein is a toy vehicle track set that includes track sections, and a support with at least one coupler movably connected thereto. Each coupler is sized and configured so that a track section can slid thereon. At least one coupler is pivotally connected to the support and repositionable relative thereto. When a track section is connected to a coupler, the track section and the coupler can be moved by a user relative to the support to orient the track section as desired.

Figure 1:
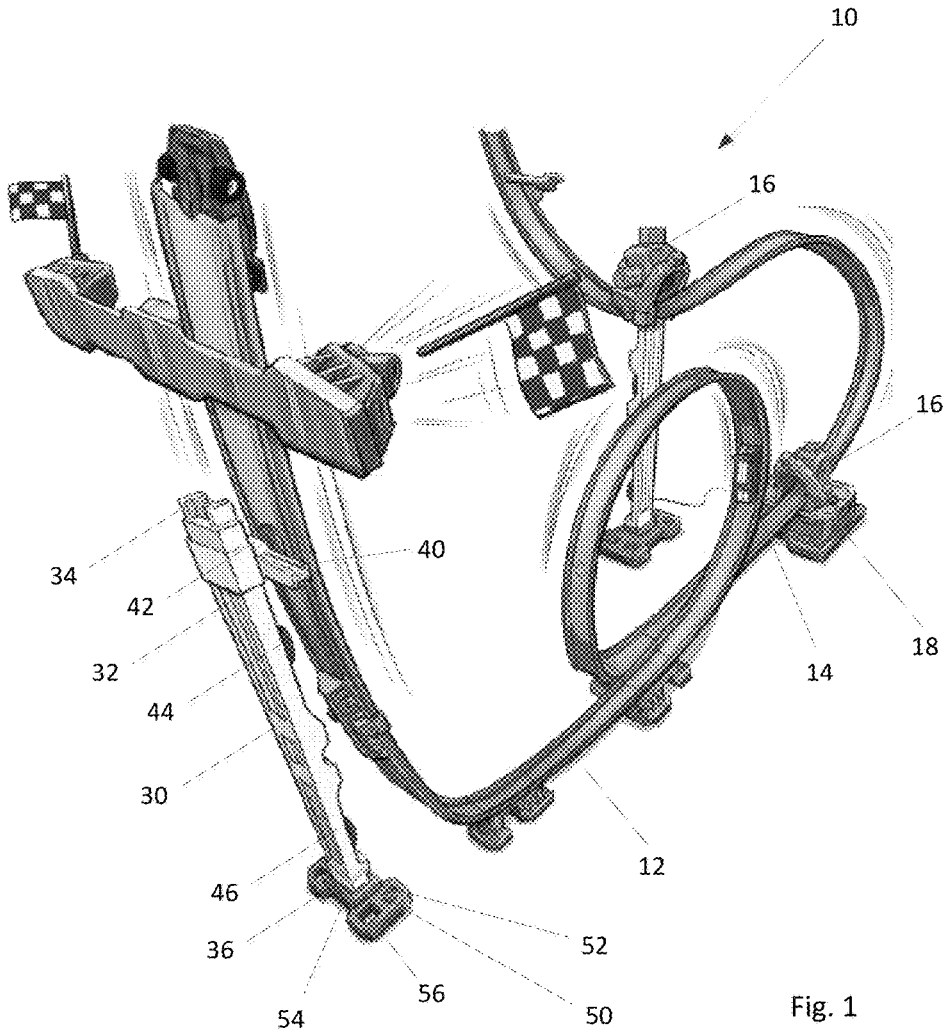
FIG. 1 illustrates a perspective view of an embodiment of a toy vehicle track set according to the present invention.

Turning to FIG. 1, illustrated is a perspective view of an embodiment of a toy vehicle track set 10. The toy vehicle track set 10 includes several sections of track 12 on which a toy vehicle 14 can travel. In this embodiment, the track set 10 includes boosters 16 that engage a passing toy vehicle 14 and impart a propelling force to the toy vehicle 14. The boosters 16 are motorized and connected to a power source 18 by wiring. As discussed in greater detail below, in one embodiment, the power source 18 is configured to receive and support a booster 16.

Track set 10 also includes a support 30 that includes an elongate or support member 32 and a base 50. The elongate member 32 is removably coupled to the base 50, and in one embodiment, each of the elongate member 32 and the base 50 is made of molded plastic. The elongate member 32 is supported by the base 50 in a generally vertical orientation. The elongate member 32 has opposite ends 34 and 36, each of which is insertable into an opening or receptacle on the base 50. The term "elongate" as used herein refers to a structure or component that is longer than it is wide.

In this embodiment, a beam or cross support member 40 is coupled to the elongate member 32. The beam 40 is removable from the support member 32. The beam 40 includes a coupler 42 movably connected thereto. The coupler 42 is sized so that a track section 12 can be slid onto the coupler 42. When a track section 12 is connected to the coupler 42, the track section 12 is supported by the support 30 and can be oriented in variety of positions by adjusting the coupler 42 relative to the support 30.

In this embodiment, the elongate member 32 has two additional couplers 44 and 46 movably connected thereto. Each of the couplers 44 and 46 can be pivoted relative to the elongate member 32, as described in greater detail below. In particular, each coupler 44 and 46 is movable relative to the support or elongate member 32 independent of each other. In other words, movement of coupler 44 about its connection point does not cause coupler 46 to move about its connection point. The movement of the couplers 44 and 46 relative to the elongate member 32 provide for adjustability of the orientation and position of the couplers 44 and 46. In alternative embodiments, the elongate member 32 may have any number of couplers.

The base 50 includes a body 52 that defines a receptacle 54 into which one of the ends 34 or 36 of the elongate member 32 is inserted. The body 52 of the base 50 has side portions that define receptacles 56 into which a toy construction or building block may be inserted. When one or more blocks are placed proximate to the base 50, a structure can be built that can be used with the track set 10.

Figure 2:
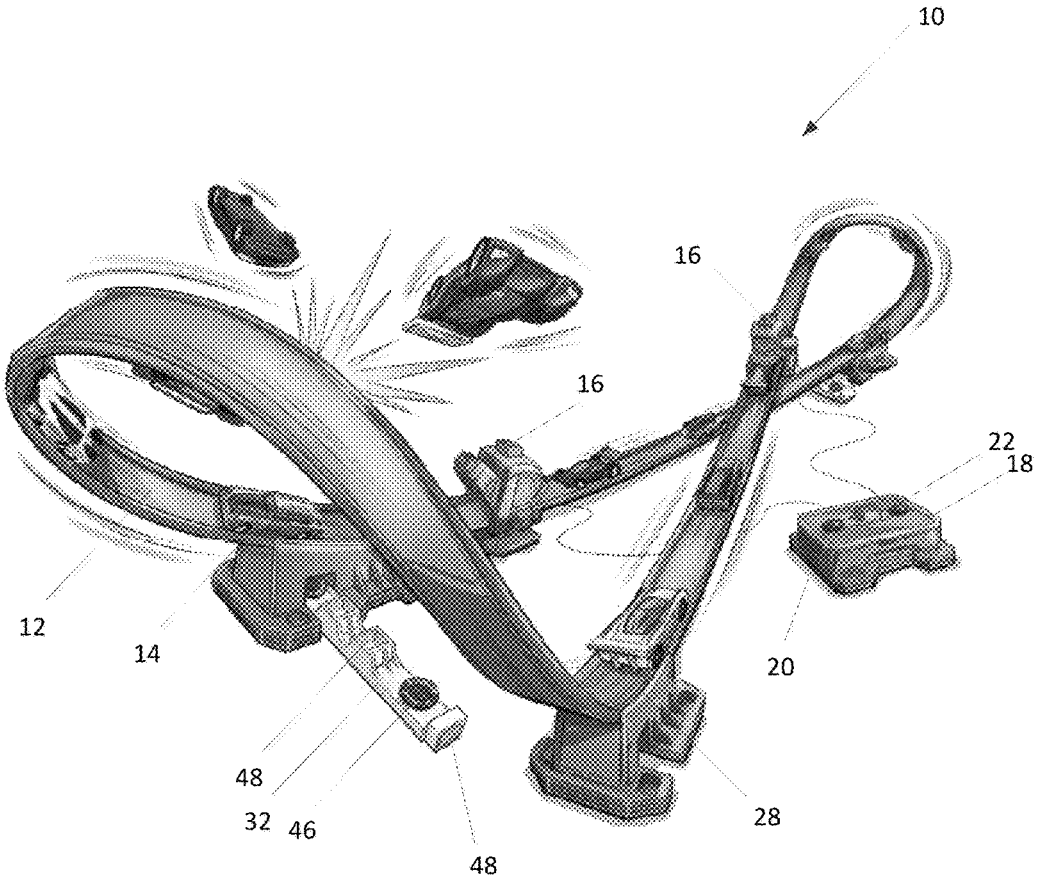
FIG. 2 illustrates a perspective view of another embodiment of a toy vehicle track set according to the present invention.
Figure 3:
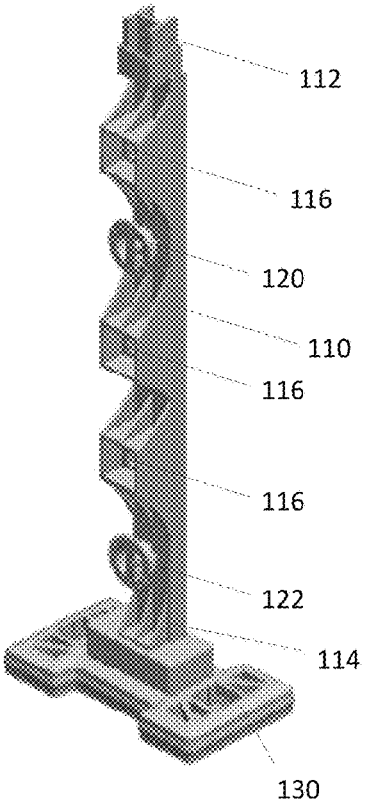
FIG. 3 illustrates a front perspective view of an embodiment of a support of a toy vehicle track set according to the present invention.
Figure 4:
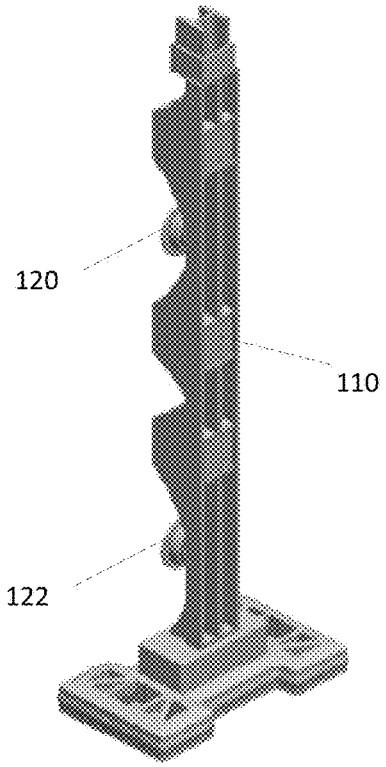
FIG. 4 illustrates a rear perspective view of the support illustrated in FIG. 3.
Figure 5:
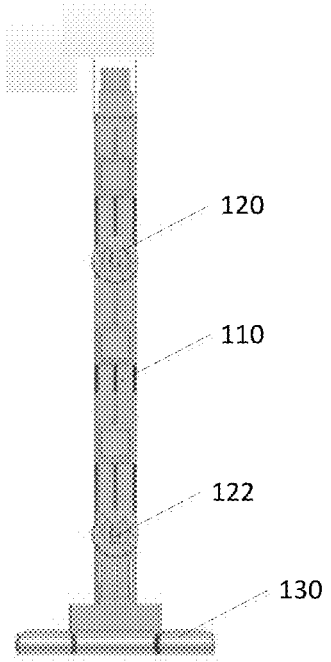
FIG. 5 illustrates a front view of the support illustrated in FIG. 3.
Figure 6:
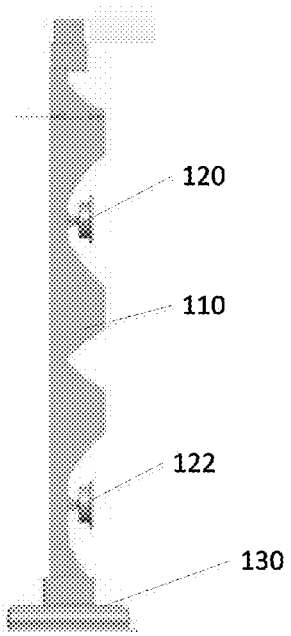
FIG. 6 illustrates a side view of the support illustrated in FIG. 3.

Referring to FIG. 2, a perspective view of an alternative arrangement of the components of the track set 10 is illustrated. In this arrangement, the track sections 12 are placed into a figure- 8 configuration and several boosters 16 are spaced apart along the track sections 12. The power source 18 is illustrated such that couplers 20 and 22 are attached to the housing of the power source 18. A track section 12 can be slid onto either of the couplers 20 and 22 so that the track section 12 is supported by the housing of the power source 18. The track set 10 also includes a ramp support 28 that supports a track section 12.

In this embodiment, the elongate member 32 is oriented substantially horizontally, as shown. The elongate member 32 includes couplers (such as coupler 46) and receptacles 48 into which the mounting portion of a beam (such as beam 40) or other component of the track set 10 may be inserted. For example, a lower portion of a booster 16 may include a mounting portion that can be inserted into a receptacle 48 of the elongate member 32 to mount and support the booster 16.

Referring to FIGS. 3-6, various views of an embodiment of a support according to the present invention are illustrated. In this embodiment, the support includes an elongate or support member 110 and a base 130 that supports the elongate member 110. The elongate member 110 has opposite ends 112, 114 that are configured to be inserted into a receptacle in the base 130. The elongate member 110 includes several receptacles 116 that are defined by sets of walls. In addition, the elongate member 110 includes couplers 120, 122 that are movably and removably connected thereto. As described in detail below, the couplers 120, 122 are rotatable and pivotable relative to the elongate member 110.

Figure 7:
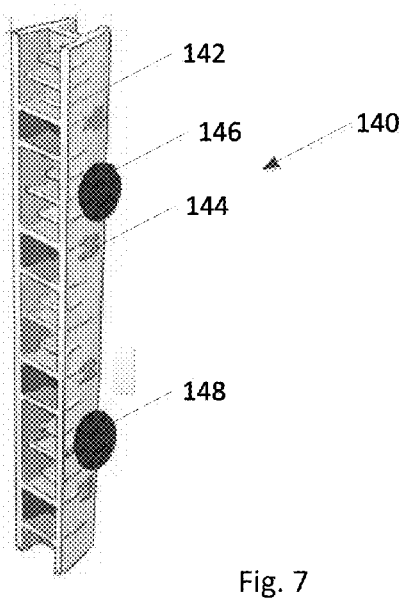
FIG. 7 illustrates a perspective view of another embodiment of a support according to the present invention.

An alternative embodiment of a support according to the invention is illustrated in FIG. 7. In this embodiment, the support 140 includes an elongate member 142 that has indicia 144 along at least one surface. The indicia 144 relates to units of distance and can be used by a user many ways, including measuring how high a toy vehicle travels, measuring the distance that track sections are mounted, etc. In addition, the elongate member 142 has two couplers 146, 148 mounted thereto.

Figure 8:
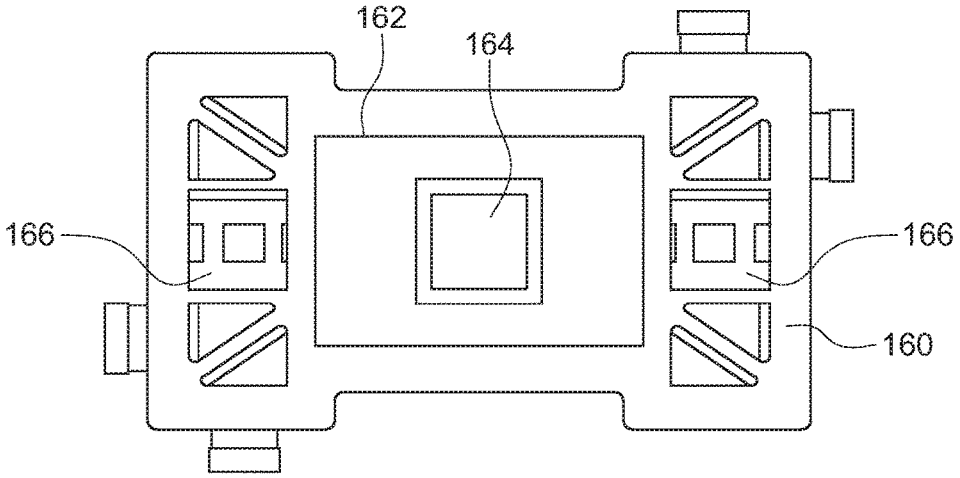
FIG. 8 illustrates a top view of an embodiment of a base according to the present invention.
Figure 9:
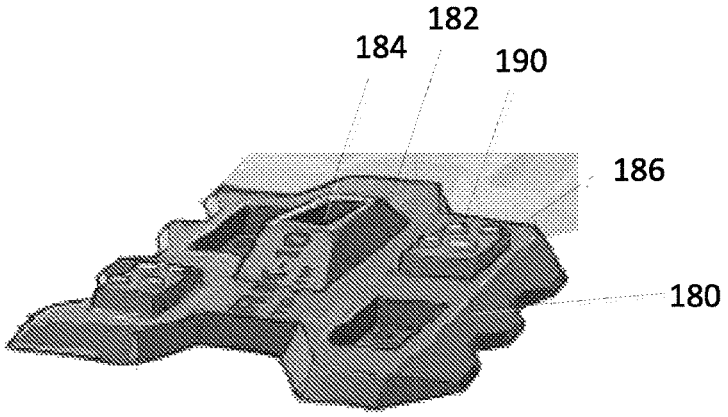
FIG. 9 illustrates a perspective view of another embodiment of a base according to the present invention.

Referring to FIGS. 8 and 9, embodiments of bases according to the present invention are illustrated. In FIG. 8, the base 160 includes a body 162 that defines a receptacle 164 into which an end of an elongate member is insertable. The base 160 includes side portions with receptacles 166 into which toy construction or building blocks may be inserted. In FIG. 9, the base 180 has body 182 defining receptacles 184 and 186. A toy construction or building block 190 is shown mounted in receptacle 186.

Figure 10:
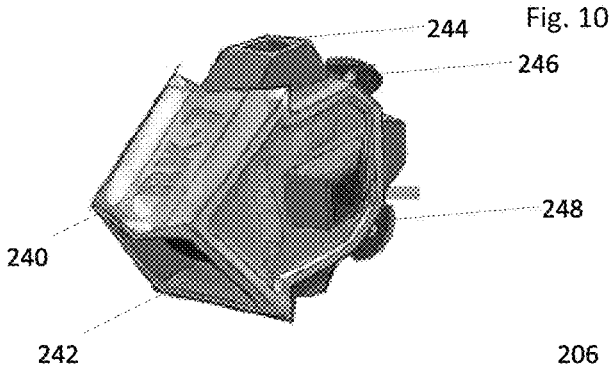
FIG. 10 illustrates a perspective view of an embodiment of a booster according to the present invention.

Referring to FIG. 10, an embodiment of a booster according to the present invention is illustrated. Booster 240 includes a housing that defines a passageway 242 that is sized so toy vehicles can travel therethrough. Inside the housing is a booster wheel (not shown) that engages toy vehicles and propels them through the housing and onto a connected track section. The booster 240 also includes a receptacle 244 that can receive a component of the track set. In addition, the booster 240 includes couplers 246 and 248 that are pivotally coupled thereto.

Figure 11:
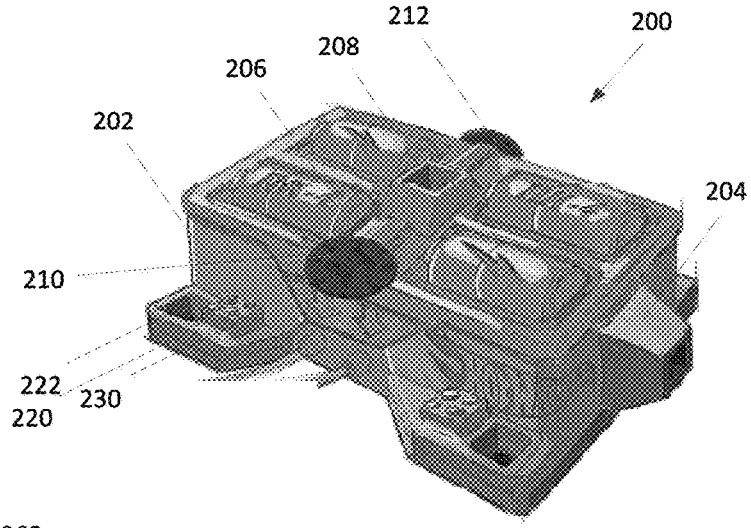
FIG. 11 illustrates a perspective view of an embodiment of a power source according to the present invention.

An embodiment of a power source according to the present invention is illustrated in FIG. 11. Power source 200 includes a housing 202 that defines a receptacle 204 and an upper surface 206 that also defines another receptacle 208. The receptacles 204 and 208 can receive a component of the track set, such as post or mounting component on a support or a booster. A pair of couplers 210 and 212 is movably mounted to the housing 202 as well. Couplers 210 and 212 are sized to engage track sections and to support the track sections relative to the housing 202. In addition, the power source 200 includes side portions 220 with receptacles 222 into which toy building blocks 230 can be inserted.

Figure 12:
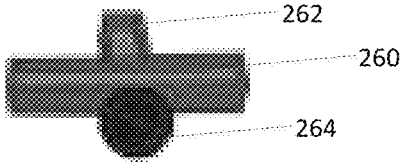
FIG. 12 illustrates a perspective view of a component that can be coupled to a support of the toy vehicle track set according to the present invention.
Figure 13:
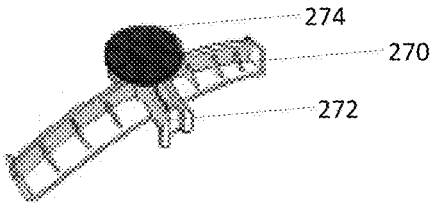
FIG. 13 illustrates a perspective view of another component that can be coupled to a support of the toy vehicle track set according to the present invention.

Referring to FIGS. 12 and 13, perspective views of alternative embodiments of beams according to the present invention are illustrated. Beam 260 includes a mounting portion 262 that can be inserted into a receptacle on an elongate member or a power source, as described above. Also mounted to the beam 260 is a coupler 264 that can be moved in a variety of directions relative to the beam 260. Similarly, beam 270 includes a mounting portion 272 and a coupler 274.

Referring to FIGS. 14-18, an embodiment of a coupler according to the present invention is illustrated. In this embodiment, the coupler 300 includes a ring or top portion 310 and a body or lower portion 320. The ring portion 310 can be referred to alternatively as a flange or flange portion. The outer diameter of the ring portion 310 is greater than the outer diameter of the body portion 320. The difference in diameter between the two portions allows the ring portion 310 to be engaged with a track section without the body portion 320 interfering with the connection.

Figure 14:
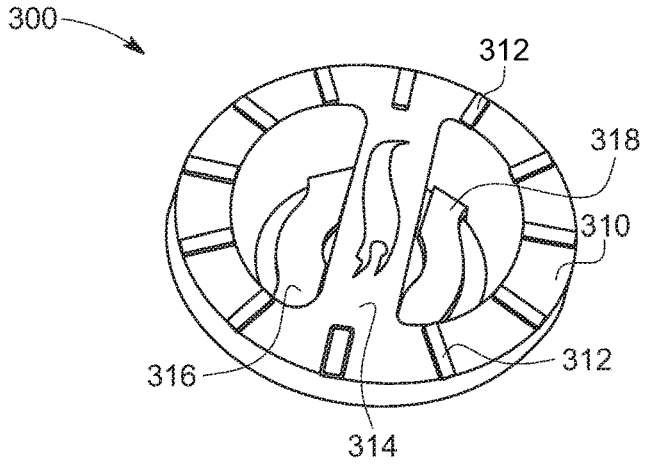
FIGS. 14-16 illustrate a top perspective view, a bottom perspective view, and a side view, respectively, of an embodiment of a coupler according to the present invention.
Figure 17:
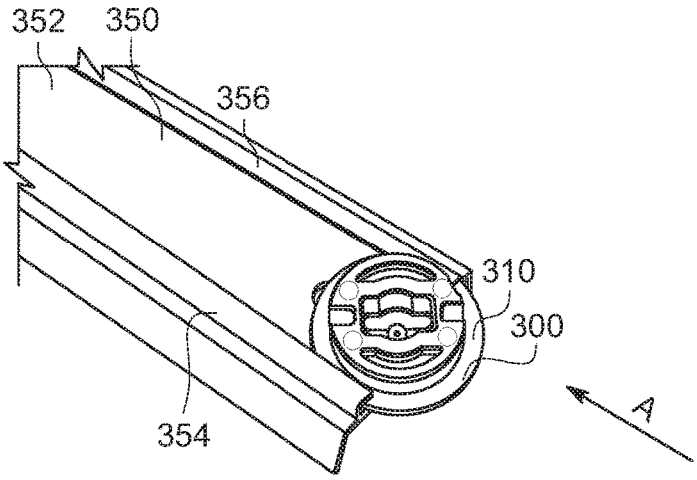
FIG. 17 illustrates a bottom perspective view of a coupler and a track section coupled together according to the present invention.

As shown in FIG. 14, the ring portion 310 includes several spaced apart ridges 312. When a track section is slid onto the ring portion 310 of a coupler 300, the ridges 312 increase the friction between the coupler 300 and the track section, thereby improving the connection of the track section to the coupler 300. Referring to FIG. 17, a track section 350 is illustrated. Track section 350 has a lower surface 352 from which two parallel rails 354 and 356 extend. The rails 354 and 356 and surface 352 collectively define the mounting section of the track section 350. The coupler 300 is slid along the lower surface 352 of the track section 350 along the direction of arrow "A" and the ring portion 310 of the coupler 300 engages the rails 354 and 356.

Referring back to FIG. 14, a centrally located cross bar 314 extends across the diameter of the ring portion 310. The bar 314 and the ring portion 310 define two open areas 316 and 318 that reduce the amount of material used to form the coupler 300.

Figure 15:
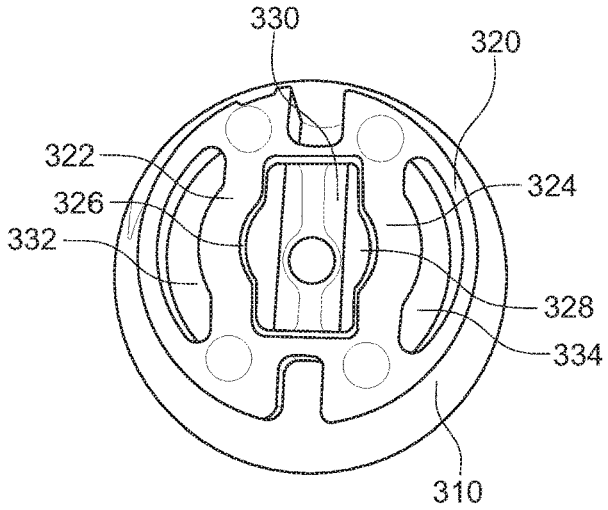
Figure 16:
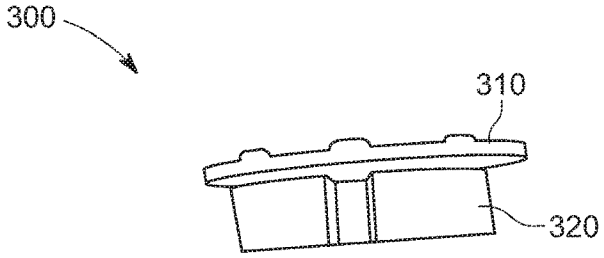

Referring to FIGS. 15 and 16, a lower perspective view and a side view of the coupler 300 are shown. The body portion 320 of the coupler 300 is generally circular. A pair of arms 322 and 324 extends across the open area of the body portion 320. The arms 322 and 324 define a central region or area 330 therebetween. The arms 322 and 324 have curved surfaces 326 and 328, respectively that engage a mounting structure to mount the coupler 300 to a support, as described in detail below. Between each arm 322 and 324 and the housing portion 320 is a free area 332 and 334, respectively. Free area 332 allows arm 322 to flex when a mounting component of a support is inserted into the central region 330. Similarly, free area 334 allows arm 324 to flex when the mounting component is inserted into the central region 330.

Figure 18:
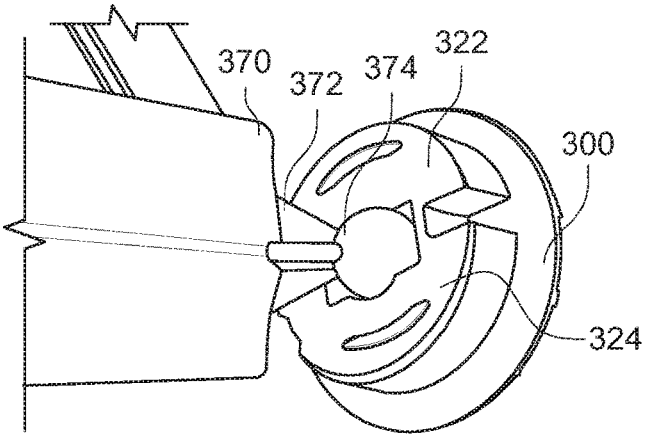
FIG. 18 illustrates a close-up perspective view of a coupler engaged with a mounting component on a support according to the present invention.

Referring to FIG. 18, an embodiment of a support 370 according to the present invention is illustrated. In this embodiment, the support 370 has several mounting components, each of which includes a post or extension 372 and a ball or ball shaped connection 374 at the distal or outer end of the post 372. As shown, the ball 374 is inserted between the arms 322 and 324 of the coupler 300 and snaps in past the arms 322 and 324 which flex and return to their original configurations once the ball 374 travels past them. As a result, the coupler 300 with arms 322 and 324 and the ball 374 form a ball joint arrangement for the mounting of the coupler 300 to the support 370. The ball joint allows the coupler 300 to be rotated and pivoted about many axes to position the coupler 300 in any desired orientation.

Figure 19:
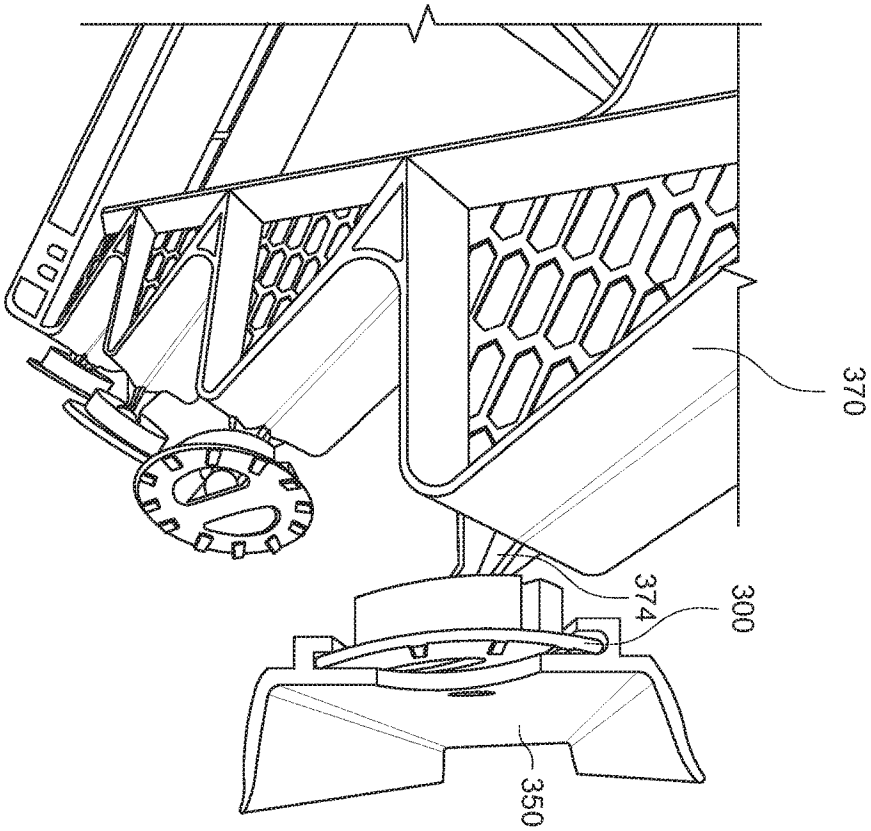
FIGS. 19-21 illustrate perspective views of track sections engaged with couplers according to the present invention.
Figure 20:
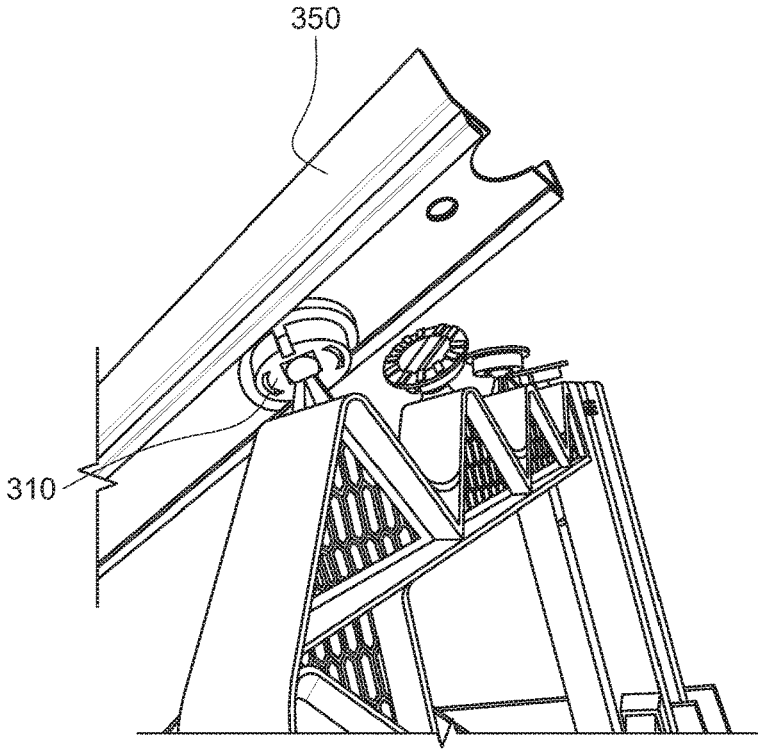
Figure 21:
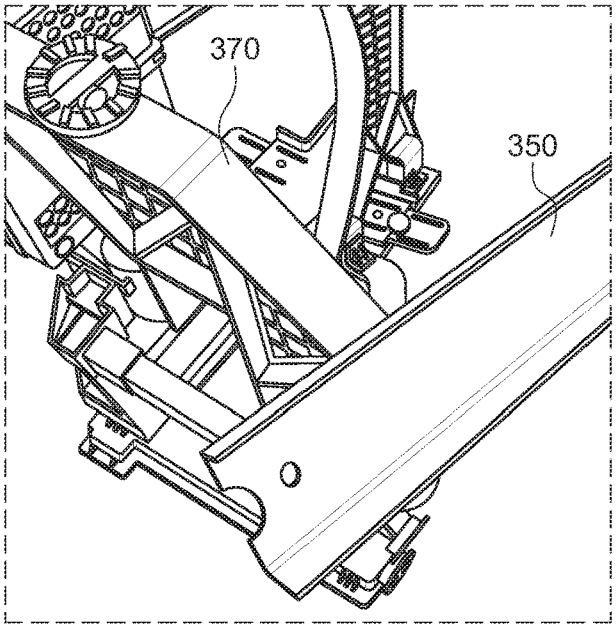

Referring to FIGS. 19-21, various additional views of a track section mounted to a coupler are shown. In FIG. 19, an end view showing the track section 350 engaged with the coupler 300 on ball joint 374 of support 370 is illustrated. In FIG. 20, a bottom view of the engagement of track section 350 and the ring portion 310 of coupler 300 is illustrated. In FIG. 21, the opposite view of the track section 350 and support 370 shown in FIG. 20 is illustrated.

Figure 22:
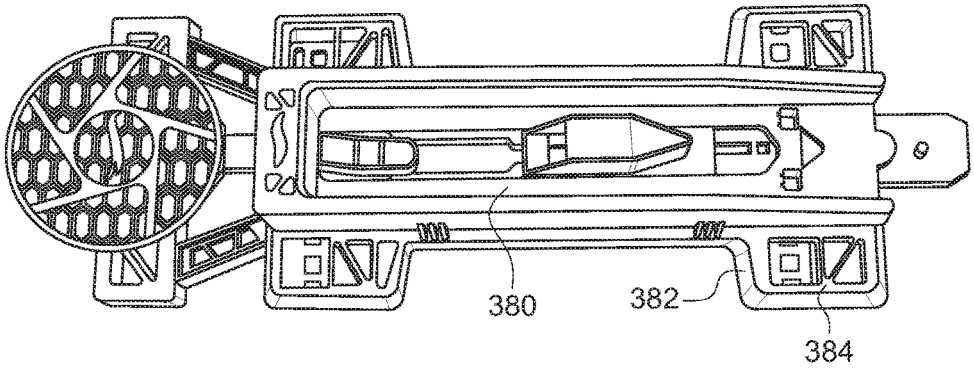
FIG. 22 illustrates a top view of an embodiment of a toy vehicle launcher according to the present invention.
Figure 23:
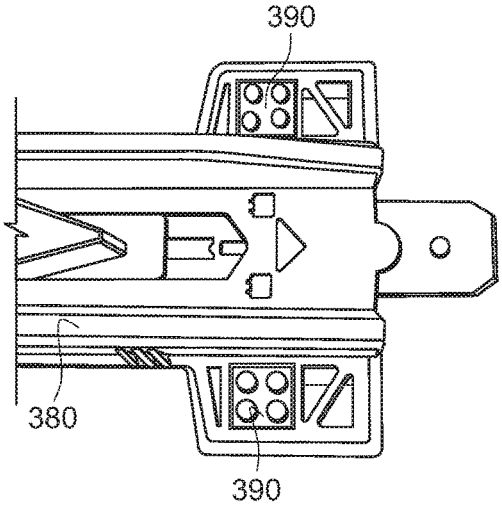
FIG. 23 illustrates a top perspective view of a portion of the toy vehicle launcher illustrated in FIG. 22.
Figure 24:
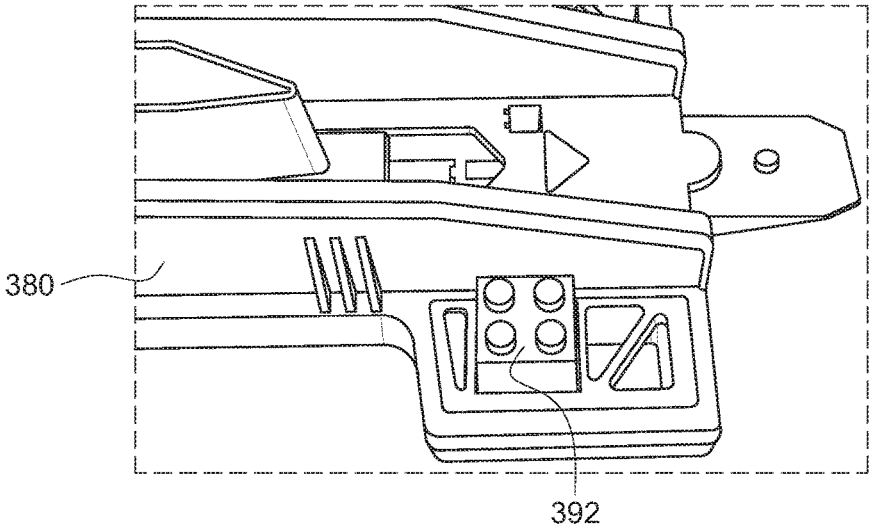
FIG. 24 illustrates another top perspective view of a portion of the toy vehicle launcher illustrated in FIG. 22.

In an alternative embodiment of the present invention, the toy vehicle track set includes a launcher that can be used to propel or launch toy vehicles. Referring to FIGS. 22-24, different views of a launcher 380 according to the present invention are illustrated. The launcher 380 includes a base with a side portion 382 that defines a receptacle 384 into which a single toy construction or building block 390 or a stack 392 of toy construction or building blocks may be inserted. The blocks can be used as the foundation or base of a larger structure made of additional blocks.

In an alternative embodiment, the one or more of the couplers connected to an elongate member may be fixed to the support and not removable. In another embodiment, the shape of the mounting component on the support may vary. For example, the round smooth spherical surface of the ball 374 may be replaced by an end that has many facets.

In an alternative embodiment, the elongate member may be replaced with a support portion that has a configuration different than the elongate member in terms of the width and length of the support portion. In other words, the support portion may have width and length dimensions that are substantially similar.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A toy vehicle track set, comprising:

a track section having a lower surface and a mounting portion proximate to the lower surface; and a support configured to be placed on a support surface, the support including:

a base defining a receptacle; and a support member removably coupleable to the base, the support member having a first end and a second end opposite the first end, at least one of the first end and the second end being insertable into the receptacle of the base, the support member having a coupler movably connected thereto, wherein the coupler engages the mounting portion of the track section and slides along the lower surface of the track section, thereby connecting the track section to the support and allowing the track section to be moved relative to the support.

2. The toy vehicle track set of claim 1, wherein the coupler is removably coupled to the support member.

3. The toy vehicle track set of claim 1, wherein the mounting portion of the track section includes a pair of rails, and the coupler engages the rails.

4. The toy vehicle track set of claim 3, wherein the coupler includes a flange portion and the flange portion engages each of the rails.

5. The toy vehicle track set of claim 4, wherein the flange portion has a ring shape.

6. The toy vehicle track set of claim 4, wherein the flange portion of the coupler includes ridges formed thereon, and the ridges on the flange portion engage the lower surface of the track section.

7. The toy vehicle track set of claim 1, wherein the coupler has a flange portion and a body portion, and an outer diameter of the flange portion is larger than an outer diameter of the body portion.

8. The toy vehicle track set of claim 1, wherein the support member includes a mounting component with a ball-shaped connection, and the coupler can snap onto and pivot about the ball-shaped connection.

9. The toy vehicle track set of claim 7, wherein the coupler includes a pair of arms defining a central region, and the ball-shaped connection is insertable into the central region.

10. The toy vehicle track set of claim 1, wherein the support member is elongate.

11. The toy vehicle track set of claim 1, wherein the receptacle of the base is a first receptacle and the base includes a second receptacle, the second receptacle of the base being sized to retain a toy building block therein.

12. The toy vehicle track set of claim 11, further comprising:

a toy building block insertable into the second receptacle.

13. A toy vehicle track set, comprising:

a track section having a lower surface and a mounting portion proximate to the lower surface; and a support that supports the track section, the support including:

a base defining a receptacle; and an elongate member removably coupleable to the base, the elongate member being insertable into the receptacle of the base so that the elongate member is supported above a support surface, the elongate member having a coupler rotatably and removably connected thereto, the mounting portion of the track section being slidable onto the coupler along the lower surface of the track section so that the track section is connected to the support and can be moved relative to the support.

14. The toy vehicle track set of claim 13, wherein the mounting portion of the track section includes a pair of rails that extend from the lower surface of the track section, and the coupler engages the rails.

15. The toy vehicle track set of claim 14, wherein the coupler includes a ring-shaped flange portion and the flange portion engages each of the rails when the track section is slid onto the coupler.

16. The toy vehicle track set of claim 15, wherein the flange portion of the coupler includes ridges formed thereon, and the ridges engage the lower surface of the track section.

17. The toy vehicle track set of claim 13, wherein the elongate member includes a mounting component with a ball portion, and the coupler snaps onto and pivots about the ball portion.

18. The toy vehicle track set of claim 17, wherein the coupler includes a pair of arms defining a central region, and the ball portion is insertable into the central region.

19. A toy vehicle track set, comprising:

a track section having a lower surface and a pair of rails extending from the lower surface, the lower surface and the pair of rails collectively defining a mounting portion; and a support including:

a base defining a receptacle; and an elongate member removably coupleable to the base, the elongate member being insertable into the receptacle of the base so that the elongate member is supported above a support surface, the elongate member having first and second mounting portions and first and second couplers rotatably and removably connected to a respective one of the mounting portions, wherein at least one of the first and second couplers engages the pair of rails of the mounting portion of the track section and is slidable along the lower surface of the track section, thereby connecting the track section to the support and allowing the track section to be movable relative to the support.

20. The toy vehicle track set of claim 19, wherein the first coupler and the second coupler are movable independent of each other.

* * * * *